US011781319B2

(12) United States Patent
Guzman et al.

(10) Patent No.: US 11,781,319 B2
(45) Date of Patent: Oct. 10, 2023

(54) STRUCTURAL BRACKET ASSEMBLY

(71) Applicant: HARDIE BOYS, INC., Pompano Beach, FL (US)

(72) Inventors: David Guzman, Pompano Beach, FL (US); Lionel Guzman, Pompano Beach, FL (US)

(73) Assignee: Hardie Boys, Inc., Pompano Beach, FL (US)

( * ) Notice: Subject to any disclaimer, the term of this patent is extended or adjusted under 35 U.S.C. 154(b) by 0 days.

(21) Appl. No.: 17/814,260

(22) Filed: Jul. 22, 2022

(65) Prior Publication Data

US 2023/0023402 A1 Jan. 26, 2023

Related U.S. Application Data

(60) Provisional application No. 63/224,660, filed on Jul. 22, 2021.

(51) Int. Cl.
*E04C 3/04* (2006.01)
*E04F 10/08* (2006.01)

(52) U.S. Cl.
CPC ..... *E04C 3/04* (2013.01); *E04F 10/08* (2013.01); *E04C 2003/0465* (2013.01)

(58) Field of Classification Search
CPC ..... E04C 3/04; E04C 2003/0465; E04C 2003/026; E04F 10/08
See application file for complete search history.

(56) References Cited

U.S. PATENT DOCUMENTS

| | | | | |
|---|---|---|---|---|
| 6,082,071 | A * | 7/2000 | Richardson | E04D 3/08 52/DIG. 17 |
| 9,388,587 | B2 * | 7/2016 | Guzman | G05B 19/4097 |
| 9,719,259 | B2 * | 8/2017 | Guzman | E04F 19/02 |
| 10,745,914 | B1 * | 8/2020 | Fox | E04C 3/04 |
| 10,934,718 | B2 * | 3/2021 | Tucker | E04B 9/005 |
| 11,566,415 | B1 * | 1/2023 | Phan | E04B 1/2612 |
| 2016/0130823 | A1 * | 5/2016 | Guzman | E04F 19/0436 700/98 |
| 2017/0067259 | A1 * | 3/2017 | Guzman | E04F 19/02 |
| 2020/0224426 | A1 * | 7/2020 | Tucker | E04B 9/005 |
| 2023/0003020 | A1 * | 1/2023 | Nadeau | B60P 3/32 |

* cited by examiner

*Primary Examiner* — Rodney Mintz
(74) *Attorney, Agent, or Firm* — McHale & Slavin, P.A.

(57) ABSTRACT

A structural bracket assembly for a residential or commercial trellis. The structural bracket assembly comprises an aluminum mounting plate securable to a vertical wall having a support member extending outwardly therefrom at an angle and terminating with an end plate. Plywood is fastened to the top and the bottom of the support member. Roofing material is fastened to the upper piece of plywood, and a soffit panel is secured to the lower piece of plywood. A frieze board is secured to the vertical wall beneath the lower piece of plywood to conceal the mounting plate, and a hollow rafter tail is secured to the soffit panel. In one embodiment, the rafter tail is spaced apart from a support bracket by a cross beam.

9 Claims, 7 Drawing Sheets

STRUCTURAL BRACKET ASSEMBLY

CROSS REFERENCE TO RELATED APPLICATION

In accordance with 37 C.F.R. 1.76, a claim of priority is included in an Application Data Sheet filed concurrently herewith. Accordingly, the present invention claims priority to U.S. Provisional Patent Application No. 63/224,660 entitled "STRUCTURAL BRACKET ASSEMBLY", filed Jul. 22, 2021; the contents of which are incorporated herein by reference.

FIELD OF THE INVENTION

This invention is directed to the field of architecture design for residential and commercial properties; and, in particular, to a structural bracket assembly to support cellular polyvinylchloride or similar material used in pergolas, trellises and the like structures.

BACKGROUND OF THE INVENTION

Pergolas and trellises are commonly used to enhance the architectural design of a building or property. Typically constructed from wood, such structures can be free standing or wall mounted. Unfortunately, wood is susceptible to decay. Commonly the decay is dry rot. Dry rot is caused by certain fungi which grow when sufficient moisture is present, allowing the fungi to digest the wood. Besides the maintenance required for wood to keep its appeal, weakened wood is especially problematic should the structure be exposed to high wind conditions, such as tropical storms or hurricanes. Aside from such severe weather as mentioned above, routine thunderstorms and frontal systems can create localized wind gusts exceeding 100 miles per hour.

Plastics have been recognized as a substitute for wood architectural trim structures. Plastic has weather resistant qualities, can be treated to resist ultraviolet radiation, and has a surface porosity that accepts painting. However, simply substituting plastic for a wood structure is not as desirable since plastic possesses poor structural capabilities.

What is lacking in the industry is a device for support rafter tails when used with trellises and the like structures that require reinforcement.

SUMMARY OF THE INVENTION

Applicant's invention provides a structural bracket assembly for a residential or commercial trellis wherein the rafter component conceals the structural bracket. The structural bracket assembly comprises a mounting plate securable to a vertical cinder or concrete wall having a support member extending outwardly therefrom at an angle between 55° and 75° relative to the vertical wall and terminating with an end plate. The support member is between $31\frac{13}{16}$ inches and $44\frac{11}{16}$ inches long. Plywood is fastened to the top and the bottom of the support member. Roofing material is then fastened to the upper piece of plywood. A frieze board is secured to the vertical wall beneath the lower piece of plywood, and fascia is fastened to the end plate. A soffit panel is positioned between the frieze board and the fascia. The soffit panel is secured to the lower piece of plywood. A rafter tail is positioned beneath the soffit panel. In one embodiment, the rafter tail includes a wall and soffit mounted clamp for securement. In another embodiment, the rafter tail is spaced apart from a decorative support bracket by a decorative cross beam.

Modern buildings made of cinder block or cement block provide an alternative to conventional rafter tails. Conventional rafter tails are a major component of the soffit system in timber frame construction. Rafter tails can be used to emulate traditional timber frame construction. Some of these vernaculars or styles are Coastal, British West Indies, Dutch Indies, Cape Cod, New England, Key West, Charleston, Spanish Mediterranean, Colonial, Low Country, and Craftsmen style homes, which all prominently use wood rafter tails, wood corbels, and wood bracket detailing.

A method of manufacturing architectural components such as rafter tails may be found in Applicant's Patent Registration U.S. Pat. No. 9,388,587, the contents of which are incorporated herein by reference. Said rafter tails are constructed of free foam Cellular PVC which can be formed into a limitless a number of shapes and sizes. PVC rafter tails have many different characteristics that improve the life, looks, and longevity of an exterior rafter. PVC rafter tails are impervious to moisture, mildew, rot, cracking, warping, and insects or pests.

An objective of the invention is to provide a wall mounted trellis capable of structural support, as well as withstanding high winds and storm conditions by use of a concealed aluminum wall support member.

Another objective of the invention is to provide architectural trim components that can be manufactured using materials and techniques that create a structural support that will not rot, crack or warp, and is otherwise weather resistant.

Yet still another objective of the invention is to provide an architectural trim that is hollow, making it lighter and easier to install versus wood or solid plastic trim.

Another objective of the invention is to provide an architectural trim product that looks the same as traditional architectural trim made from wood yet eliminates all the problems associated with wood.

Still another objective of the invention is to provide a process that allows manufacturing of cellular PVC components to create an unlimited combination of shapes and sizes from sheet goods of varying thicknesses.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENT

Figure 1:
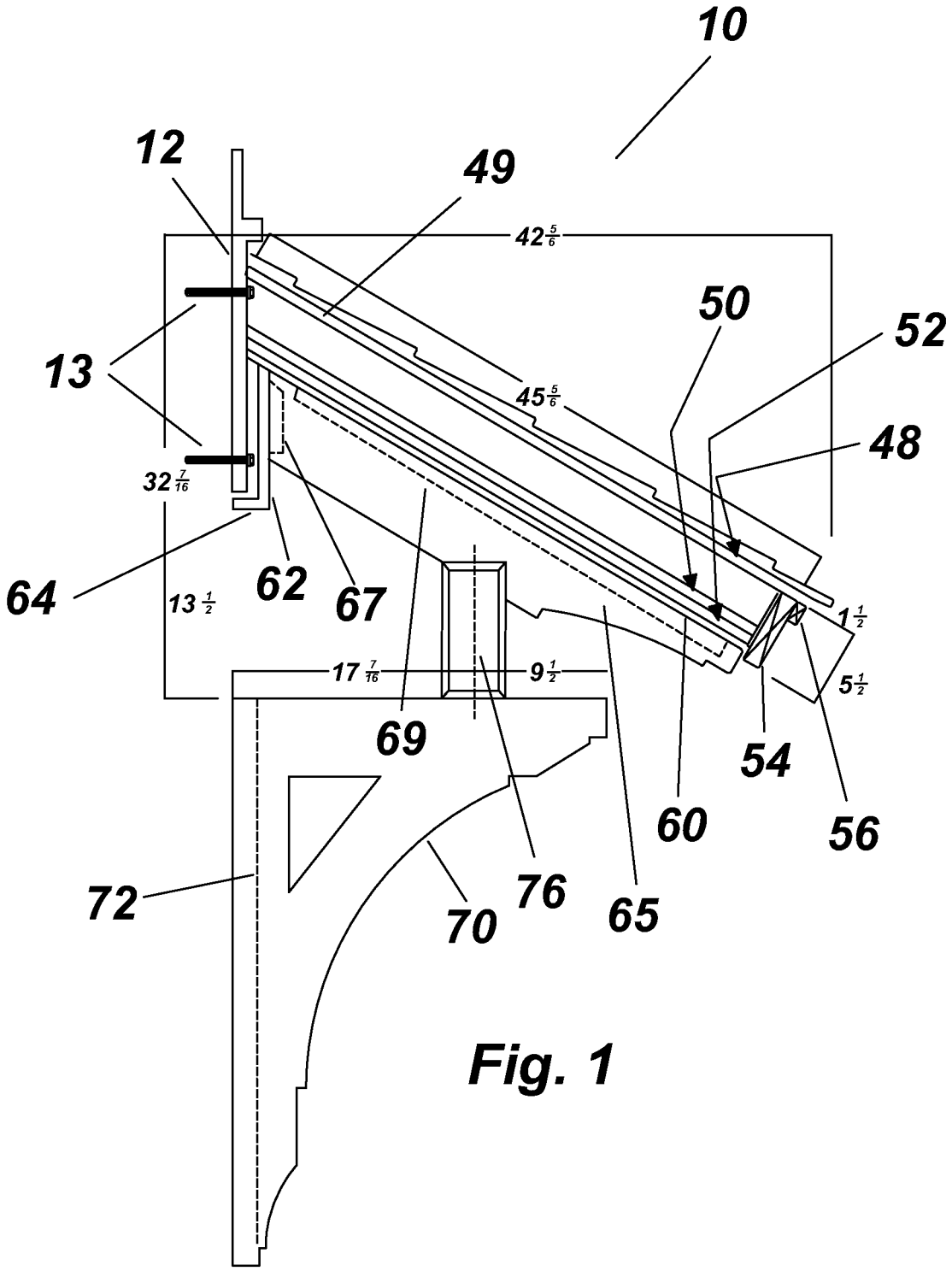
FIG. 1 is a cross-sectional view of the structural bracket assembly with a beam supported rafter tail.
Figure 2A:
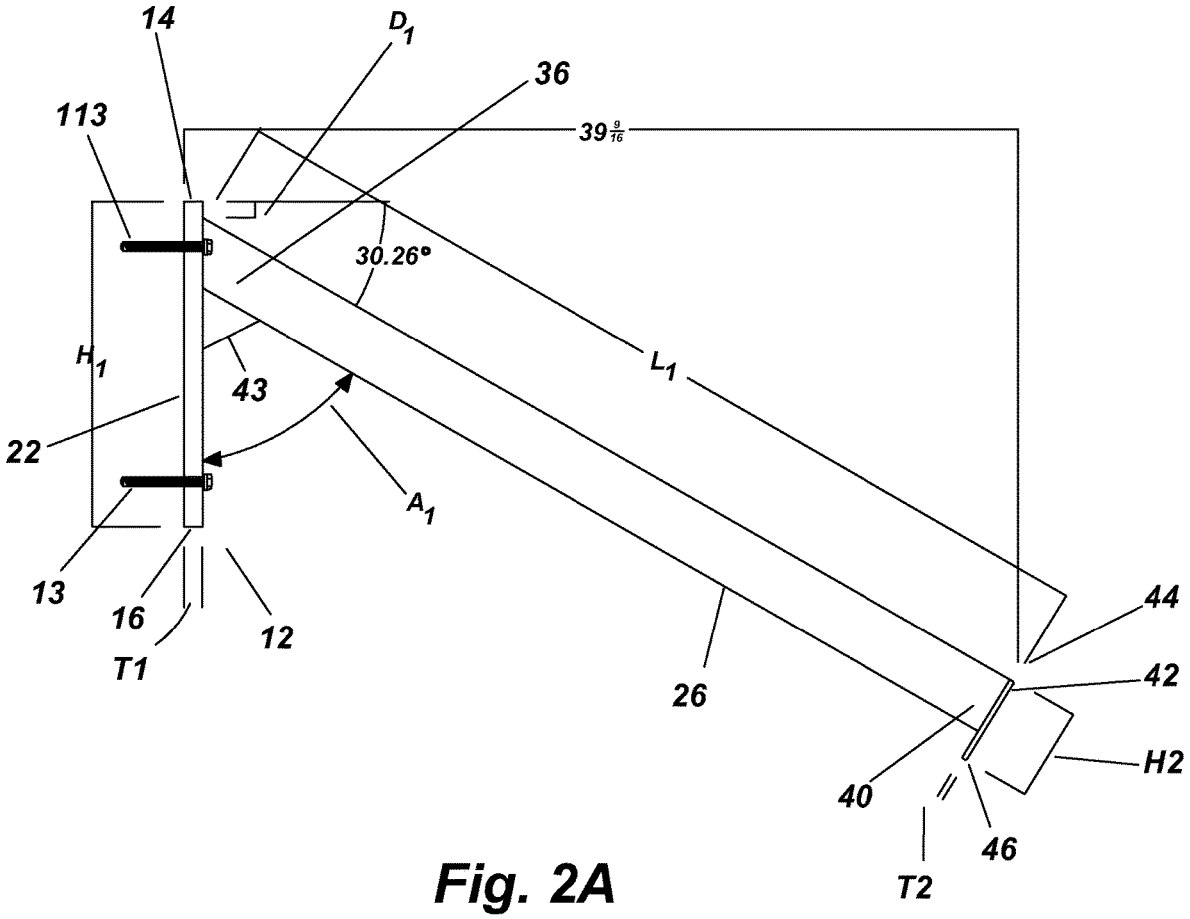
FIG. 2A is a cross-sectional side view of the structural bracket.
Figure 2B:
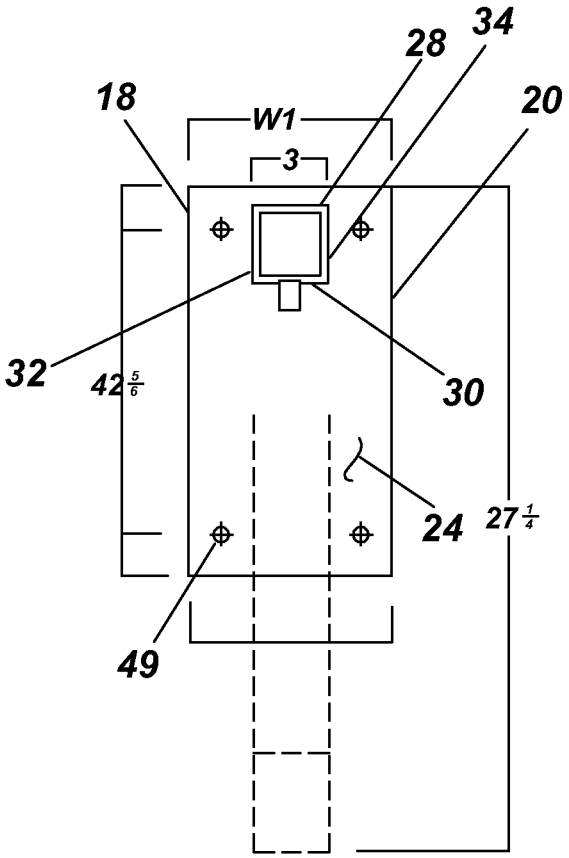
FIG. 2B is a cross-sectional end view of the structural bracket.
Figure 3B:
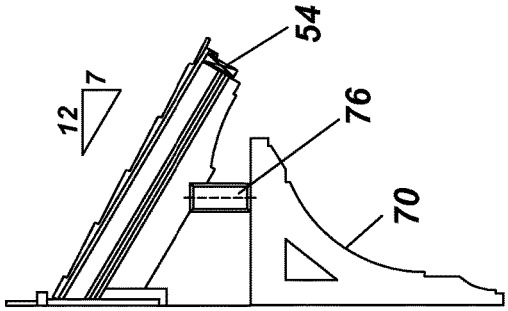
FIG. 3B is a side view thereof.
Figure 4B:
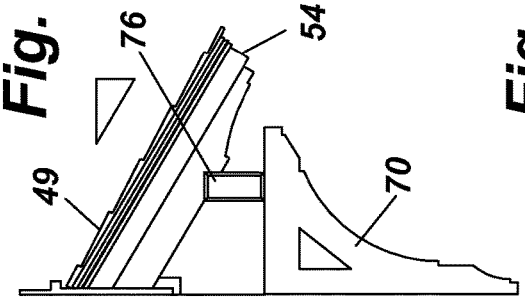
FIG. 4B is a side view thereof.
Figure 3A:
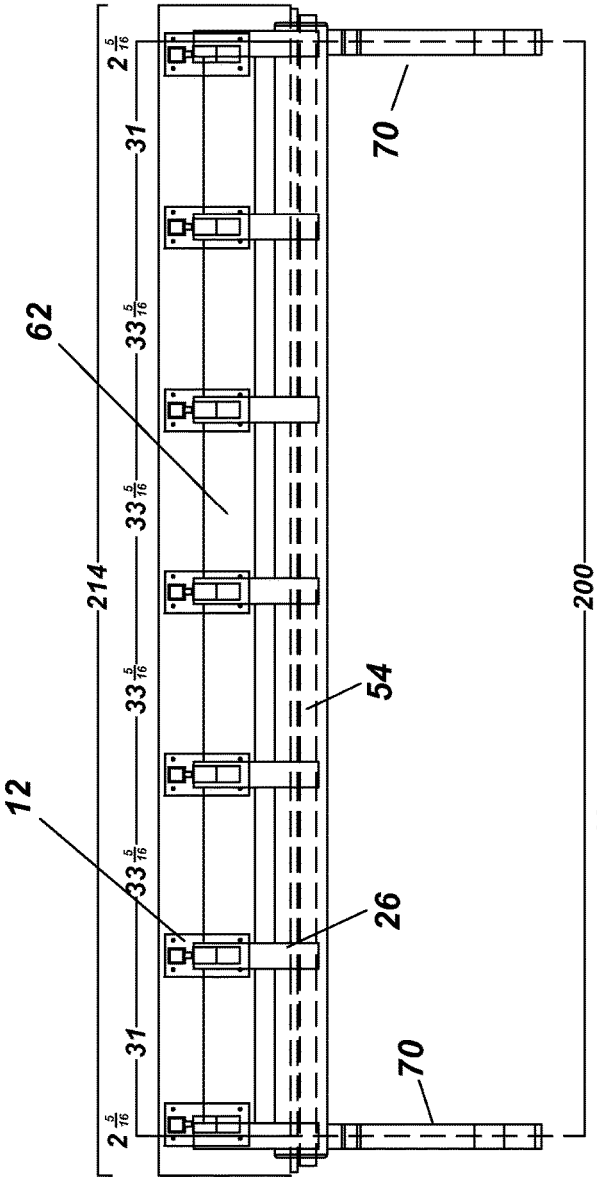
FIG. 3A is a cross-sectional front view of the structural bracket assembly mounted on a wall.
Figure 4A:
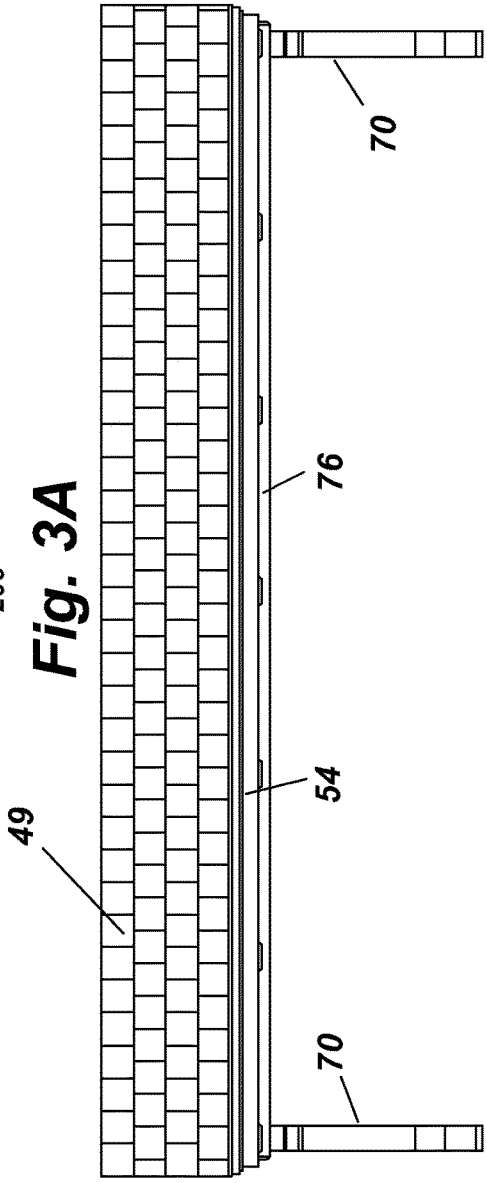
FIG. 4A is a front view of the structural bracket assembly mounted on a wall.

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Referring to FIGS. 1-4B, illustrated is the structural bracket assembly 10 of the instant invention comprising a mounting plate 12 securable to a vertical wall, not shown, with fasteners 13. The mounting plate 12, measured between an upper edge 14 spaced apart from a lower edge 16, has a height H1 of between 12 and 16 inches. A first side edge 18 is spaced apart from a second side edge 20 by approximately 8 inches in width W1; and a rear surface 22 is spaced apart from a front surface 24 by approximately 1 inch thickness T1.

A support member 26 formed from a 3-inch square tube has a top wall 28, a bottom wall 30, and opposing side walls 32, 34. The top wall 28 has a proximal end 36 centrally secured to the front surface 24 of the mounting plate 12, preferably at a distance Dl of about ¾ inch from the upper edge 14. The support member 26 bottom wall 30 is attached to the mounting plate 12, positioning the support member 26 at an angle A1 between 55° and 75° relative to the front surface 24. In a preferred embodiment, the angle A1 would be 55° when used in combination with a non-structural support beam, described later in this specification, and 75° for a conventional soffit support. The support member 26 and mounting plate 12 are constructed from aluminum and welded together. A distal end 40 of the top wall 28 of support member 26 extends outwardly a length L1, in most instances, the length L1 is between 30 inches and 45 inches long; however, various lengths are possible and considered within the scope of this invention. An end plate 42 is secured to the distal end 40 of the support member 26. For the longer length, a gusset 43 is welded between the mounting plate 12 and the support member 26. The end plate 42 has a top edge 44 spaced apart from a bottom edge 46 by about a height H2 of 4 inches, and a thickness T2 of about ¼ inch.

An upper piece of ⅝ inch plywood 48 is fastened to the top wall 28 of the support member 26. The mounting plate 12 has apertures for receipt of fasteners 13 for attaching the mounting plate to a wall structure. Roofing material 49 is fastened to the upper piece of plywood 48. A lower piece of ⅝ inch plywood 50 is fastened to the bottom wall 30 of the support member 26. A further piece of plywood 52 may also be attached to the lower piece of plywood 50, providing a thicker soffit. The length of the fasteners 13 used to secure the plywood 48, 50 and 52 together is sized to allow common attachment. Fascia 54 is secured to the end plate 42, and a trim board 56 can be used as decorative trim to further conceal the adjoining seam between the fascia 54 and the upper piece of plywood 48. A soffit panel 60 is secured to the lowest piece of plywood 52, and a frieze board 62 with an angled edge 64 is installed to conceal the mounting plate 12. A hollow rafter tail 65 is attached to the frieze board 62 and secured by a first cleat 67 and a second cleat 69 by adhesive and fasteners.

In this embodiment, a non-functional decorative bracket 70 can be attached to the wall by a wall mounted cleat 72. The bracket 70 is attached to the cleat 72 by adhesive and fasteners. The decorative bracket 70 can be of most any architectural design; the design depicted is for illustration only. A non load bearing beam 76 may be placed on the top of the decorative bracket 70 to further the trellis design.

Figure 5:
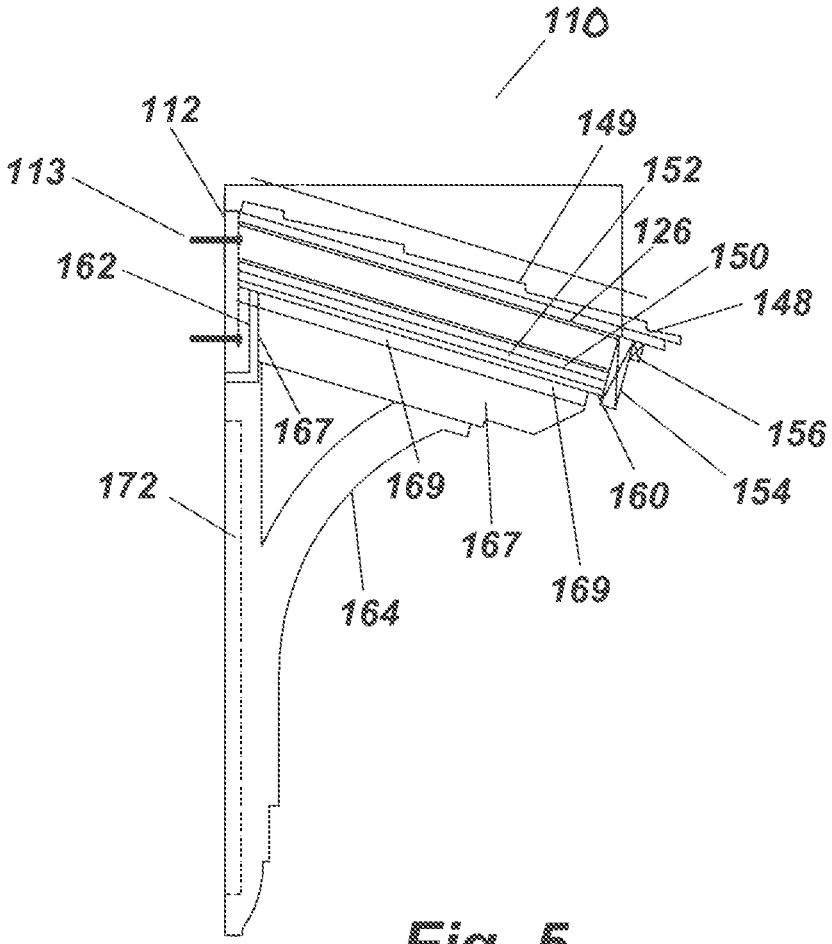
FIG. 5 is a cross-sectional view of the structural bracket assembly with a direct adjoining rafter tail.
Figure 6:
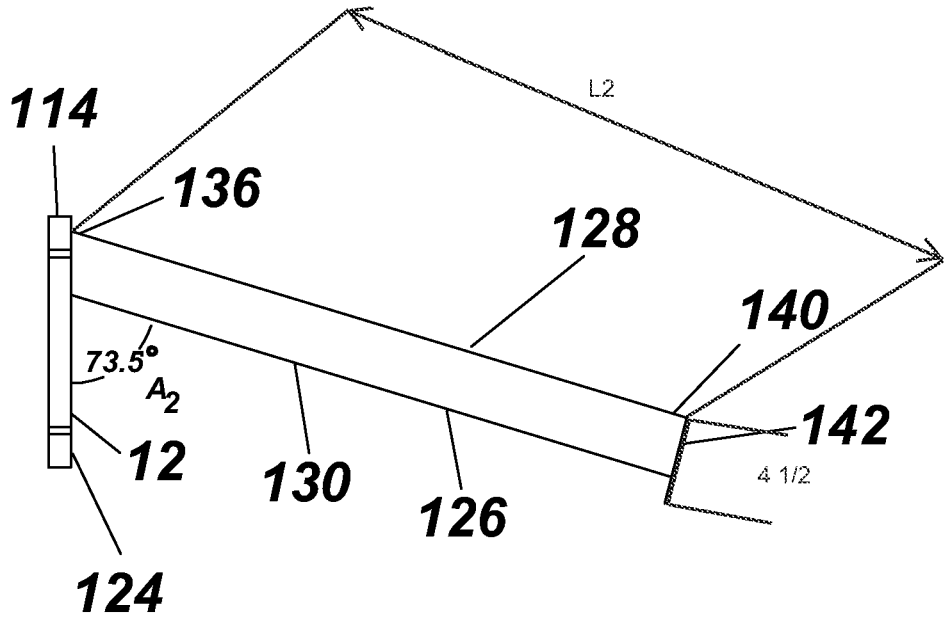
FIG. 6 is a cross-sectional view of the structural bracket.
Figure 7:
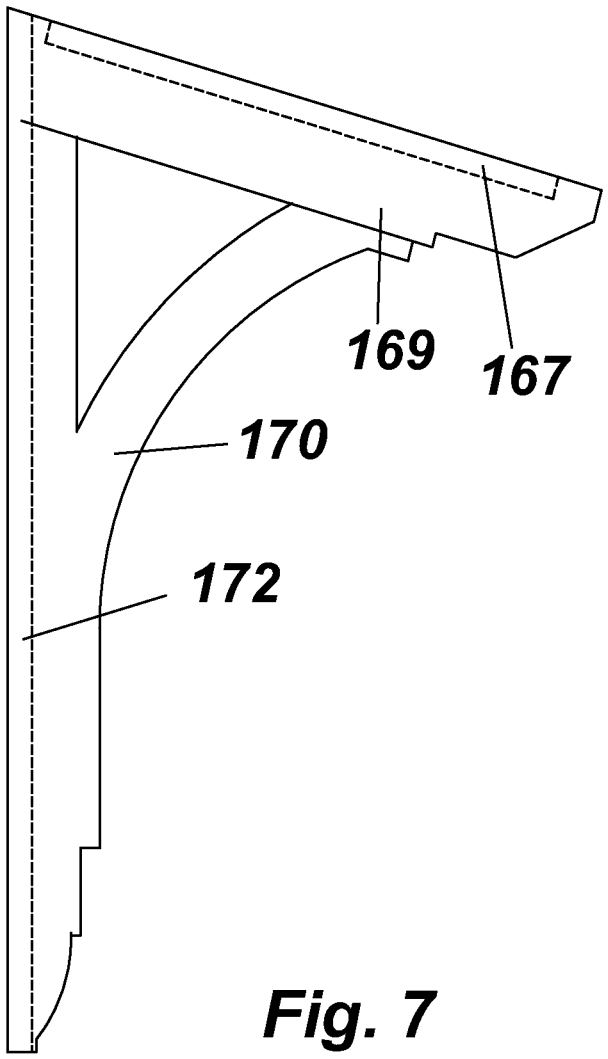
FIG. 7 is a plane side view of a rafter tail.

Referring to FIGS. 5-7, illustrated is the structural bracket assembly 110 for a direct configuration, comprising a mounting plate 112 securable to a vertical wall by fasteners 113. The mounting plate 112 is permanently attached to the support member 126, a 3-inch square tube. In this embodiment, the angle A2 is about 75° and no gusset is employed. The top wall 128 of the support member 126 has a proximal end 136 centrally secured to the front surface 124 of the mounting plate 112, preferably at a distance of about ¾ inch from the upper edge 114. The support member 126 bottom wall 130 is attached to the mounting plate 112 by weldment. A distal end 140 of the top wall 128 of the support member 126 extends outwardly a length L2, in this embodiment 31 13/16 inches; again various lengths, widths, and heights are possible and considered within the scope of this invention. An end plate 142 is secured to the distal end 140 of the support member 126.

Roofing material 149 is fastened to an upper piece of plywood 148. A lower piece of ⅝ inch plywood 150 is fastened to the bottom wall 130 of the support member 126. An additional piece of plywood 152 may also be attached to the lower piece of plywood 150, providing a thicker soffit, if desired. The length of the fasteners 113 are adjusted accordingly, allowing the pieces to be attached without exposing the ends of fasteners. Fascia 154 is fastened to the end plate 142, and a trim board 156 can be used for decorative trim. A soffit panel 160 is secured to the lowest piece of plywood, 150 or 152, and a frieze board 162 with an angled edge 164 is installed to conceal the mounting plate 112. A rafter tail 167 is attached to a cleat 169 by adhesive and fasteners. In this embodiment, the non-functional decorative rafter tail 167 and bracket 170 can be attached by the wall mounted cleat 172. The decorative bracket rafter tail 167 and bracket 170 can be of most any architectural design; the design depicted is for illustration only.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "about" or "approximately" means the stated value plus or minus 5%. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

What is claimed is:

1. A structural bracket assembly comprising:

at least one mounting plate securable to a vertical wall, said mounting plate having an upper edge spaced apart from a lower edge, a first side edge spaced apart from a second side edge by approximately 8 inches in width, and a front surface spaced apart from a rear surface by approximately 1 inch thickness;

at least one support member formed from a 3-inch square tube having a top wall, a bottom wall, and opposing side walls, said top wall having a proximal end centrally secured to said front surface of said support member along said upper edge of said mounting plate, and said bottom wall attached thereto, positioning said support member at an angle relative to said mounting plate, and a distal end of said top wall of said support member extending outwardly therefrom;

an end plate secured to said distal end of said support member, said end plate having a top edge spaced apart from a bottom edge by about 4.5 inches, and a thickness of about ¼ inch;

an upper piece of plywood fastened to a top of said support member;

roofing material fastened to said upper piece of plywood;

at least one lower piece of plywood fastened to a bottom of said support member;

a frieze board secured to said vertical wall beneath said lower piece of plywood to conceal said mounting plate; fascia fastened to said end plate;

a soffit panel positioned between said frieze board and said fascia, said soffit panel secured to said lower piece of plywood; and a hollow rafter tail secured to said soffit panel and spaced apart from a support bracket by a cross beam.

2. The structural bracket according to claim 1 wherein said support member is secured to said front surface at a location about ¾ inch beneath said upper edge.

3. The structural bracket according to claim 1 wherein said support plate includes at least four apertures for receipt of fasteners.

4. The structural bracket according to claim 1 wherein said plywood is ⅝ inch thick.

5. The structural bracket according to claim 1 wherein said soffit panel is a ¾" nickel joint panel.

6. The structural bracket according to claim 1 wherein said top wall of said support member is between 30 and 45 inches long.

7. The structural bracket according to claim 1 wherein said mounting plate and said support member are constructed of aluminum and attached at said angle by weldment.

8. The structural bracket according to claim 1 wherein said angle is between 55° and 75°.

9. The structural bracket according to claim 1 wherein said upper edge of said mounting plate is spaced apart from said lower edge of said mounting plate between 12 to 16 inches.

* * * * *